US009790712B2

(12) United States Patent
Li

(10) Patent No.: US 9,790,712 B2
(45) Date of Patent: Oct. 17, 2017

(54) MAGNETIC CODING FREE PIN TYPE LOCK CYLINDER STRUCTURE

(71) Applicant: Xin Li, Zhuhai (CN)

(72) Inventor: Xin Li, Zhuhai (CN)

(73) Assignee: Xin Li, Zhuhai (CN)

( * ) Notice: Subject to any disclaimer, the term of this patent is extended or adjusted under 35 U.S.C. 154(b) by 0 days.

(21) Appl. No.: 15/127,794

(22) PCT Filed: Mar. 19, 2015

(86) PCT No.: PCT/CN2015/000187
§ 371 (c)(1),
(2) Date: Sep. 21, 2016

(87) PCT Pub. No.: WO2015/143922
PCT Pub. Date: Oct. 1, 2015

(65) Prior Publication Data

US 2017/0096839 A1 Apr. 6, 2017

(30) Foreign Application Priority Data

Mar. 22, 2014 (CN) ..... 2014 1 0107543

(51) Int. Cl.
*E05B 47/00* (2006.01)
*E05B 17/14* (2006.01)

(52) U.S. Cl.
CPC ..... *E05B 47/0044* (2013.01); *E05B 17/142* (2013.01)

(58) Field of Classification Search
CPC ..... E05B 47/0044; E05B 17/142
USPC ..... 70/276
See application file for complete search history.

(56) References Cited

U.S. PATENT DOCUMENTS 4,228,667 A * 10/1980 Herriott ..... E05B 47/0044 70/276
4,841,758 A * 6/1989 Ramblier ..... E05B 47/0044 70/276

FOREIGN PATENT DOCUMENTS

| | | | | |
|---|---|---|---|---|
| CN | 2352615 Y | | 12/1999 | |
| CN | 2389215 Y | | 7/2000 | |
| CN | 201447943 U | | 5/2010 | |
| CN | 103938931 A | | 7/2014 | |
| CN | 104005606 A | * | 8/2014 | ..... E05B 19/26 |
| CN | 203856278 U | | 10/2014 | |
| CN | 203924995 U | * | 11/2014 | |
| RU | 2101449 C1 | | 1/1998 | |
| RU | 2193088 C1 | | 11/2002 | |

* cited by examiner

*Primary Examiner* — Suzanne Barrett
(74) *Attorney, Agent, or Firm* — Gokalp Bayramoglu

(57) ABSTRACT

A magnetic coding free pin type lock cylinder structure includes: a lock cylinder housing (101), a lock knob (104) disposed within the lock cylinder housing (101), a lock cylinder front end cover (102) and a lock cylinder rear end cover (103). Pin vertically moving grooves (114) and pin horizontally rotary grooves (113) are provided on an inner wall of the lock cylinder housing (101). An unlocking hole (116) for a magnetic coding key (115) is provided on the lock knob (104). A plurality of pin vertical sliding grooves (112) is provided on an outer wall of the lock knob (104). Free pins are provided in at least one of the plurality of pin vertical sliding grooves (112), and the free pins are big pins (107) or small pins (108).

6 Claims, 11 Drawing Sheets

MAGNETIC CODING FREE PIN TYPE LOCK CYLINDER STRUCTURE

FIELD OF THE DISCLOSURE

The present invention relates to a magnetic coding free pin type lock cylinder structure.

BACKGROUND

It is a common way to lock the facility door with a lock and a manual operating mechanism in the industrial fields (such as: electric power petrochemical, transportation, metallurgy coal and etc.), which is an indispensable safety measure to prevent the accident risk. Currently, ordinary locks easily bought on the market are mainly used. Majority of these locks have a lock cylinder with a "marbles-spring" or "blade" structure, which leads to great defects in industrial applications mainly in terms of reliability: a. lock cylinder components are susceptible to rust due to the imperfect waterproof structure, especially in the maritime climate, acid rain climate or an environment with an electrochemical reaction; b. the dust can easily enter into the lock cylinder by the lock hole in a severe dust environment, which leads to failure to unlock the door, because there is no dustproof structure for the lock hole. To solve this problem, a new lock structure is developed. For example, as shown in FIG. 1, an earlier Chinese utility model patent No. 200920060169.0 of this applicant discloses a magnetic coding lock cylinder and a magnetic coding padlock which can withstand the harsh environment. Although the document makes a great improvement for addressing the problems, there are still some deficiencies in terms of low anti-picking capacity, complex structure, high production cost, and poor manufacturability etc. Wherein, the low anti-picking capacity means that when the lock cylinder manufactured in accordance with the utility model patent is horizontally placed relative to the ground, the pins in the lock cylinder are located in a random position and the lock cylinder may be unlocked by picking the lock cylinder With a picking rod, especially in the situation with few lock codes (directly relating to few pins). Compared with the ordinary locks, the structure is complex and the manufacturing cost is high. Eleven components are needed for the lock cylinders having 1024 lock codes manufactured according to the utility model patent, wherein there are four types of locking blocks, whereas only seven or eight components are required for the ordinary locks. The poor manufacturability means that the lock cylinders are manufactured by a complicated manufacturing process with a relatively low productivity, primarily because the codes of the lock cylinder are formed by multiple different locking blocks arranged in the lock cylinders. It is difficult to manufacture the lock cylinder because of a variety of locking blocks and requirements for mounting angles.

Summary of invention

According to the above shortcomings and deficiencies of the prior art, the object of the present invention is tip provide a magnetic coding free pin type lock cylinder structure, with good security, high reliability, easy digital management, simple structure and manufacturing process, and low production cost.

The technical solution of the present invention is provided as follows: the present invention includes a lock cylinder housing a lock knob rotationally disposed within the lock cylinder housing, a lock cylinder front end cover and a lock cylinder rear end cover respectively located at two ends of the lock cylinder housing. At least one pin vertically moving groove and at least one pin horizontally rotary groove are provided on the inner wall of the lock cylinder housing. An unlocking hole for the magnetic coding key is provided axially at the end of the lock knob, opposite to the lock cylinder front end cover. A plurality of pin vertical sliding grooves is provided on the outer wall of the lock knob and a pin is provided in the at least one of the plurality of pin vertical sliding grooves. The free pin is a big pin or/and a small pin.

Preferably, pin moving cavities are formed by the pin vertical sliding grooves and the corresponding pin vertically moving grooves. Each pin moving cavity intersects with the pin horizontally rotary groove.

Preferably, the depth of the pin vertically moving grooves is the same as the depth of the pin horizontally rotary groove and the sum of the depth of the pin vertically moving grooves and the depth of the pin vertical sliding grooves is not less than the dimension of the big pins, to ensure that the big pins are freely movable. The depth of the pin vertically moving grooves and the depth of the pin horizontally rotary grooves are less than the dimension of the small pins and the depth of the pin vertical sliding grooves is more than the dimension of the small pins. When the lock cylinder is in a locking state, at least one big pin is located within the pin moving cavities, separate from the pin horizontally rotary grooves, or at least one small pin is not entirely located within the pin vertical sliding grooves. When the lock cylinder is in an unlocking state, the big pin is located within the pin moving cavities, intersecting with the pin horizontally rotary groove and the small pin is entirely located within the pin vertical sliding grooves.

Preferably, a dustproof device is provided within the unlocking hole. The dustproof device includes a spring and a dustproof end cover. An end of the spring is located at the bottom of the unlocking hole and connected to the lock knob. The other end of the spring is connected to the dustproof end cover. In the locking state, the dustproof end cover is pushed to the opening of the unlocking hole by the spring.

Preferably, the lock knob is located along the axis of the lock cylinder housing, and the lock cylinder front end cover and the lock cylinder rear end cover are respectively located at two ends of the lock cylinder housing and envelop the lock knob.

Preferably, an O type sealing ring and a sealing gasket are provided successively from outside to inside, along the outer circumference of the lock knob. The O type sealing ring and the sealing gasket are located between the lock cylinder front end cover and the lock cylinder housing, and in the gap between the lock cylinder rear end cover and the lock cylinder housing.

Preferably, the unlocking hole is a cylindrical hole. A groove engaged with the magnetic coding key is provided on the side wail of the opening of the unlocking hole.

Preferably, the free pins are spherical or cylindrical.

The beneficial effects of the invention are listed as follows: the invention includes a lock cylinder housing, a lock knob rotationally disposed within the lock cylinder housing, a lock cylinder front end cover and a lock cylinder rear end cover respectively located at two ends of the lock cylinder housing. At least one pin vertically moving groove and at least one pin horizontally rotary groove are provided on the inner wall of the lock cylinder housing. An unlocking hole for the magnetic coding key is provided axially at the end of the lock knob, opposite to the lock cylinder front end cover. A plurality of pin vertical sliding grooves is provided on the outer wall of the lock knob and a pin is provided in the at least one of the plurality of pin vertical sliding grooves. The free pin is a big pin or/and a small pin. Pin moving cavities are formed by the pin vertical sliding grooves and the corresponding pin vertically moving grooves. Each pin moving cavity intersects with the pin horizontally rotary groove. When the lock cylinder is in a locking state, at least one big pin is located within the pin moving cavities, separate from the pin horizontally rotary grooves, or at least one small pin is not entirely located within the pin vertical sliding grooves. When the lock cylinder is in an unlocking state, the big pin is located within the pin moving cavities, intersecting with the pin horizontally rotaty groove and the small pin is entirely located within the pin vertical sliding grooves. Wherein, the pin moving cavities with a single big pin are referred to as controlled cavities, the pin moving cavities with one or more small pins are referred to as anti-picking cavities, and the pin moving cavities with two free pins of different size are referred to as coding cavities. The quantity of the lock codes is decided by the quantity of the coding cavities. The lock code value of the lock cylinder is determined by the relative position of the big pins and the small pins in each pin moving cavity. When the lock cylinder is placed in parallel to the ground, some small pins in the coding cavities and the anti-picking cavities fall into the bottom of the pin vertically moving grooves or the pin horizontally rotary grooves. At this point, even though the big pins are located at the intersection of pin moving cavities and the pin horizontally rotary grooves, some pin moving cavities cannot enter into the unlocking state due to small pins being located within the pin vertically moving grooves or the pin horizontally rotary grooves, and thus the anti-picking problem is solved accordingly. Therefore, the invention has a good security, high reliability, simple digital management, simple structure and manufacturing process, and low production cost.

DETAILED DESCRIPTION OF THE INVENTION

Figure 1:
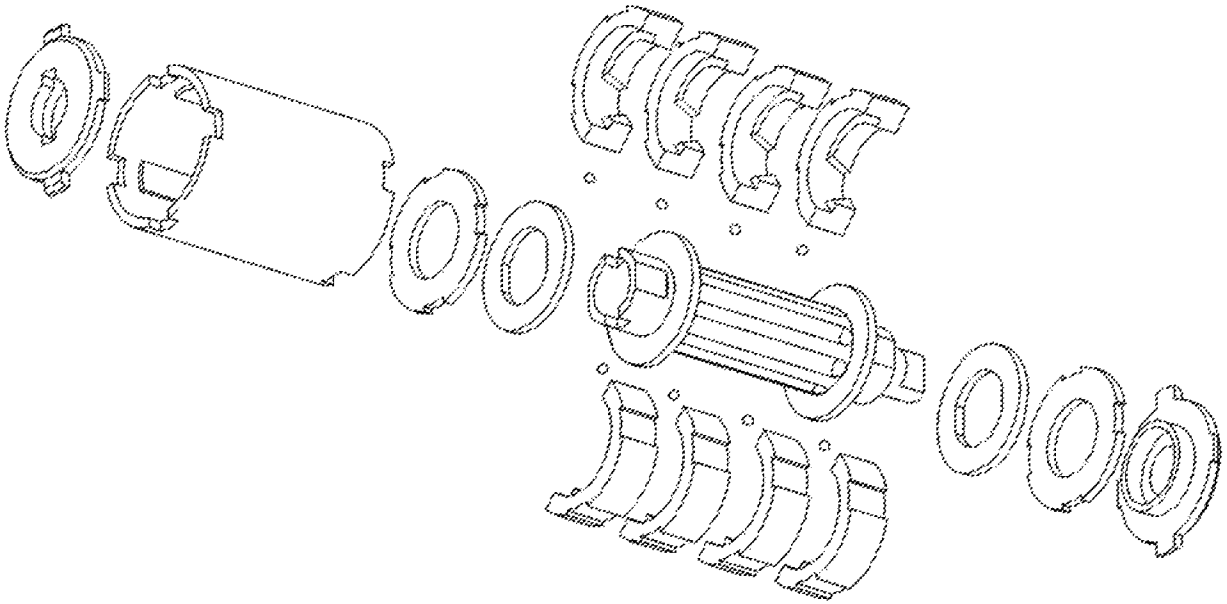
Prior Art Figure 1
FIG. 1 is a structural schematic view of a magnetic coding lock cylinder.
Figure 2:
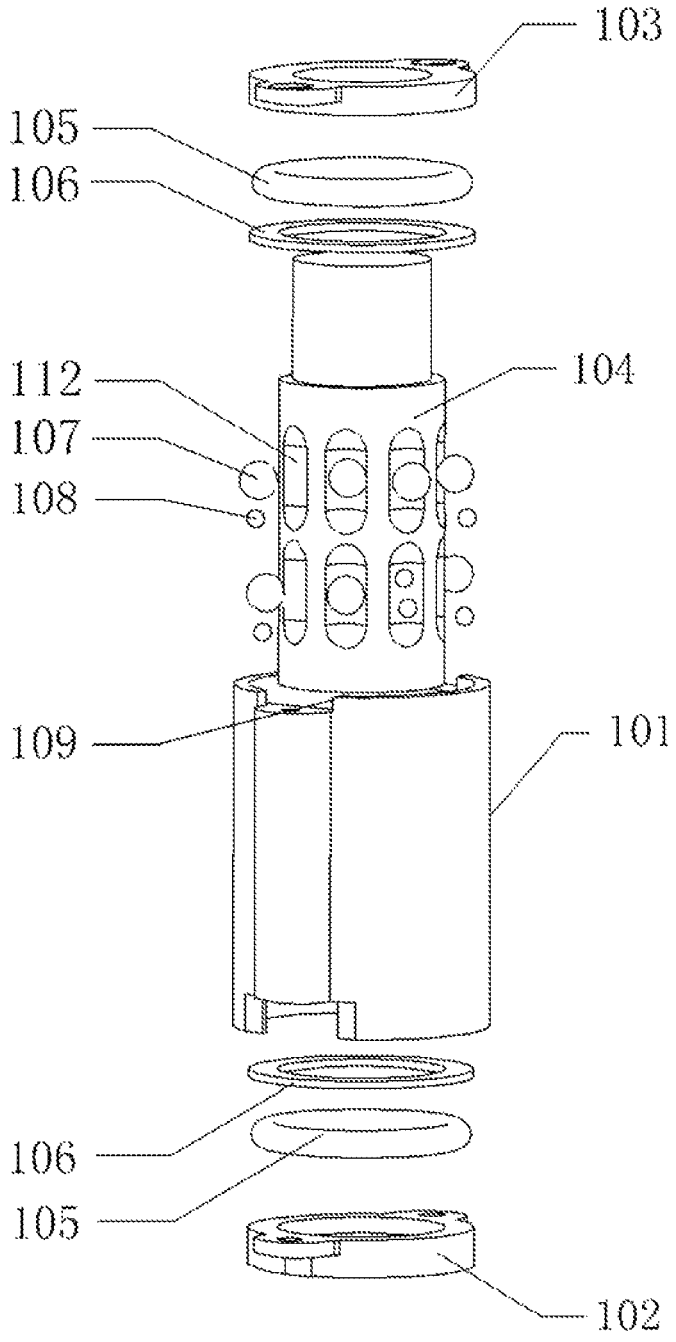
FIG. 2 is an exploded structural schematic view of the invention.
Figure 3:
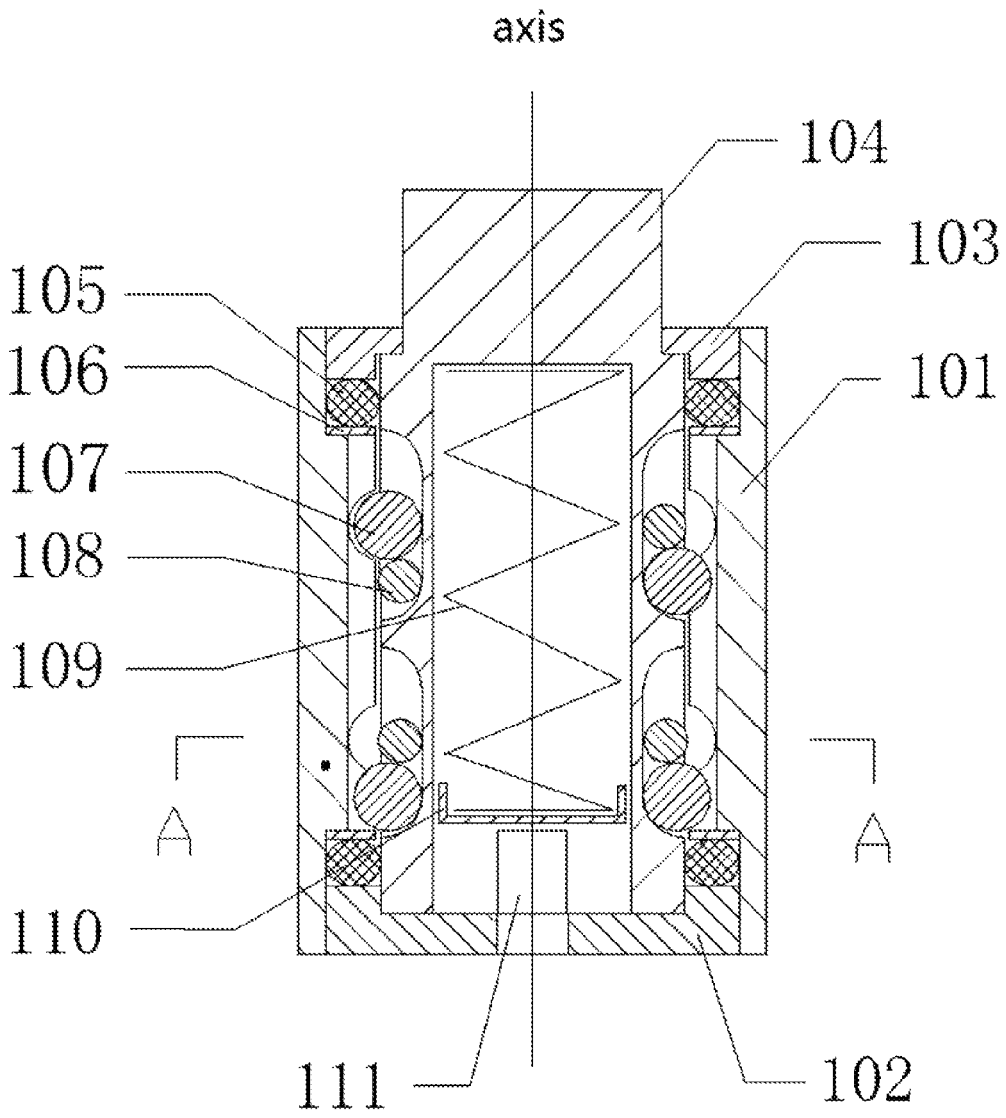
FIG. 3 is a cross section view of the locking state of the invention.
Figure 4:
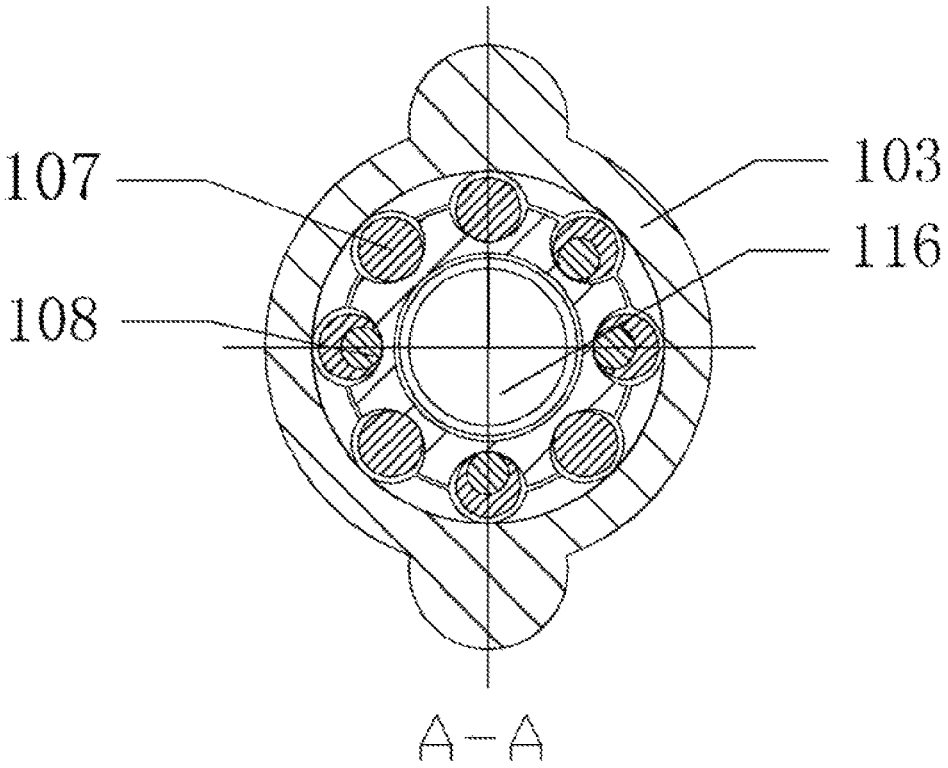
FIG. 4 is a sectional view at A-A in FIG. 3.
Figure 5:
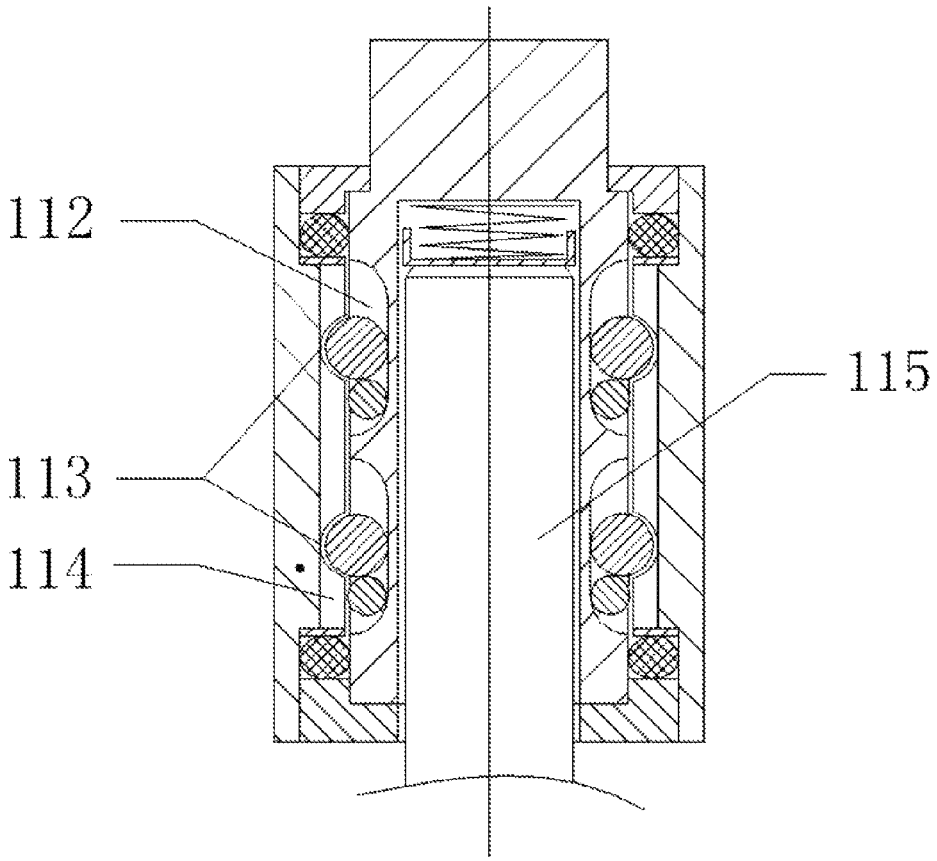
FIG. 5 is a sectional view of the unlocking state of the invention.

As shown in FIGS. 2, 3, 4, 5 and 11, a lock cylinder having 65536 different lock codes is taken as an example in the invention. The magnetic coding free pin type lock cylinder structure includes a lock cylinder housing 101, a lock knob 104 rotationally disposed within the lock cylinder housing 101, a lock cylinder front end cover 102 and a lock cylinder rear end cover 103 respectively located at two ends of the lock cylinder housing 101. Eight pin vertically moving grooves 114 are provided on the inner wall of the lock cylinder housing 101 vertically (parallel to the axis). Two pin horizontally rotary grooves 113 are provided at the intersections of the cross sections (vertical to the axis) and the inner wall of the lock cylinder housing 101. An unlocking hole 116 for the magnetic coding key 115 is provided axially at the end of the lock knob 104, opposite to the lock cylinder front end cover 102. The magnetic coding key 115 is made of magnetic material, which generates magnetic attraction to the free pins and thus controls the position of the free pins within the pin moving cavities. The unlocking hole 116 is a cylindrical hole having a diameter of 7 mm. A groove 111 engaged with the magnetic coding key 115 is provided on the side wall of the opening of the cylindrical hole. Eight pin vertical sliding grooves 112 are provided on the outer wall of the lock knob 104. Sixteen pin moving cavities are formed by the pin vertical sliding grooves 112 and the corresponding pin vertically moving grooves 114. Each pin moving cavity intersects with one pin horizontally rotary groove 113. In practice, a pin is provided in at least one of the plurality of pin vertical sliding grooves 112, while it is optional for other pin vertical sliding grooves 112. In this embodiment, each pin vertical sliding grooves 112 has free pins, which are spherical or cylindrical. In this embodiment, the free pins are preferably spherical. The free pins are big pins 107 or small pins 108 or a combination of big pins 107 and small pins 108. The big pins 107 and the small pins 108 are pins of different size. The pin moving cavities with a single big pin 107 are referred to as controlled cavities, the pin moving cavities with one or more small pins 108 are referred to as anti-picking cavities, and the pin moving cavities with two free pins of different size are referred to as coding cavities, which are used for generating different lock codes. The quantity of the lock codes is decided by the quantity of the coding cavities. The controlled cavities are mainly used for automatic control of the lock and also play a role in the coding. The anti-picking cavities are mainly used for anti-picking of the lock, without the function of coding and can be replaced by the coding cavities. The lock code value of the lock cylinder is determined by the relative position of the big pins 107 and the small pins 108 in each pin moving cavity. When the lock cylinder is in a locking state, at least one big pin 107 is located within the pin moving cavities, separate from the pin horizontally rotary grooves 113, or at least one small pin 108 is not entirely located within the pin vertical sliding grooves 112. When the lock cylinder is in an unlocking state, the big pin 107 is located within the pin moving cavities, intersecting with the pin horizontally rotary groove 113 and the small pin 108 is entirely located within the pin vertical sliding grooves 112.

Figure 6:
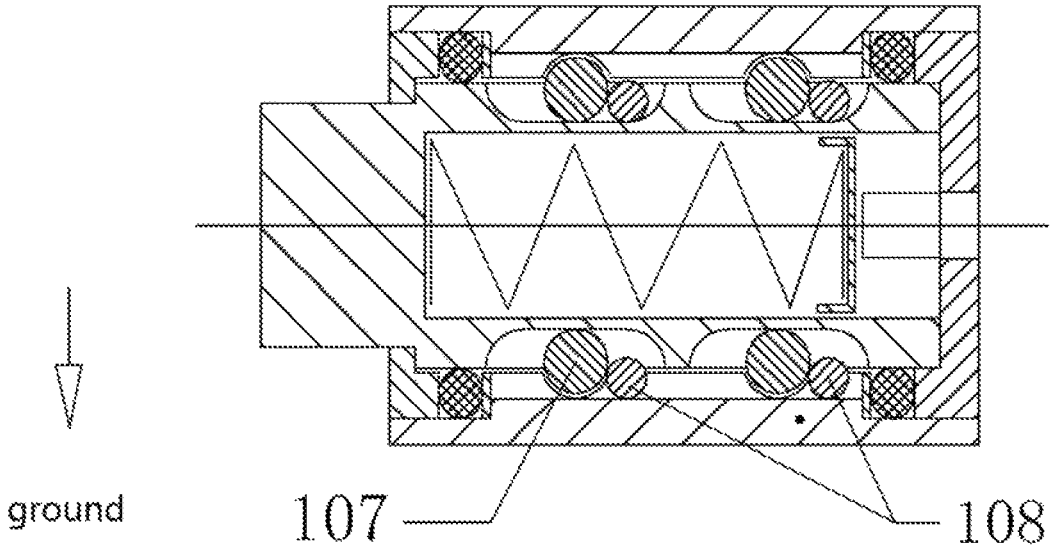
FIG. 6 is a sectional view in a horizontal state of the invention.

One pin moving cavity is taken as an example, to be described in detail as follows:

FIG. 6 is a sectional view in a horizontal state. The cavity is composed of the pin vertically moving groove 114, the pin horizontally rotary groove 113 and the pin vertical sliding groove 112 on the lock knob 104.

Figure 7:
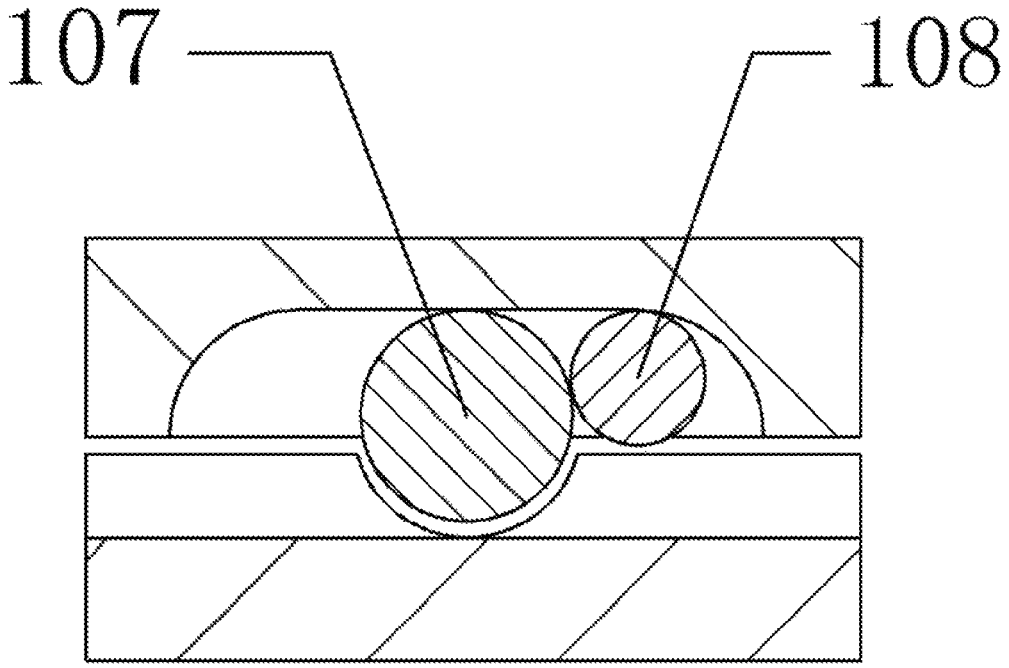
FIG. 7 is a sectional view of a coding cavity in unlocking state of the invention.

FIG. 7 is a sectional view of a coding cavity in unlocking state. Under the external force, the coding cavity enters into unlocking state when the pin moves to the indicated position.

Figure 8:
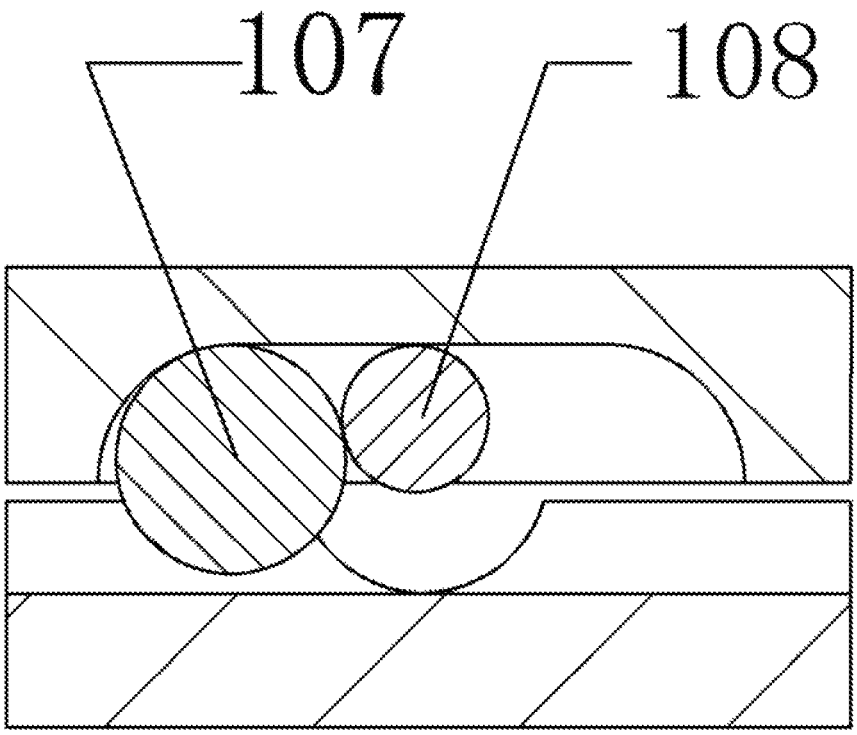
FIG. 8 is a sectional view of a coding cavity in locking state of invention.

FIG. 8 is a sectional view of a coding cavity in locking state. Under the external force, the coding cavity enters into locking state when the pin moves to the indicated position.

Figure 9:
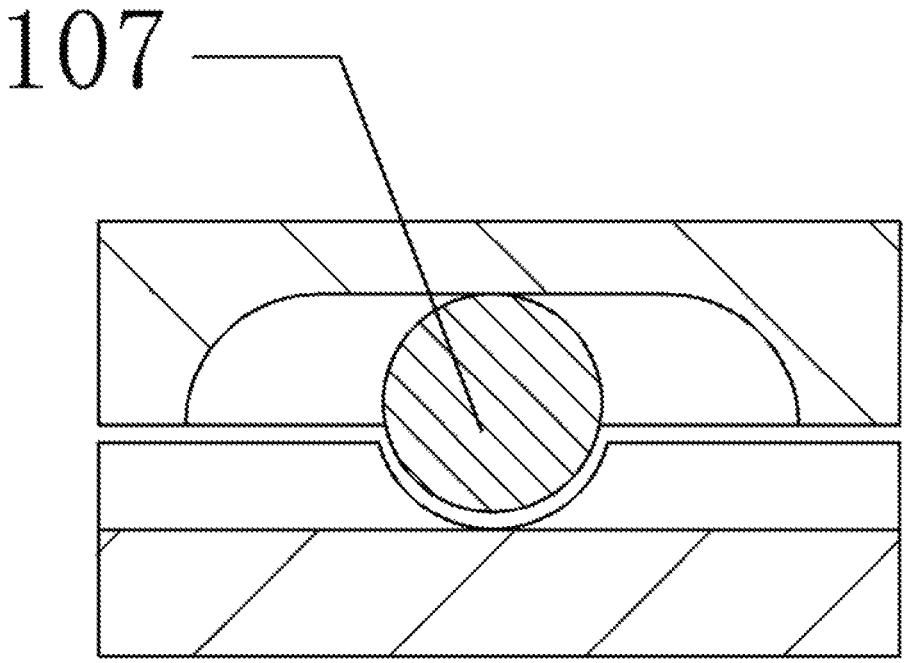
FIG. 9 is a sectional view of a controlled cavity in unlocking state of the invention.

FIG. 9 is a sectional view of a controlled cavity in unlocking state. Under the external force, the controlled cavity enters into unlocking state when the pin moves to the indicated position.

Figure 10:
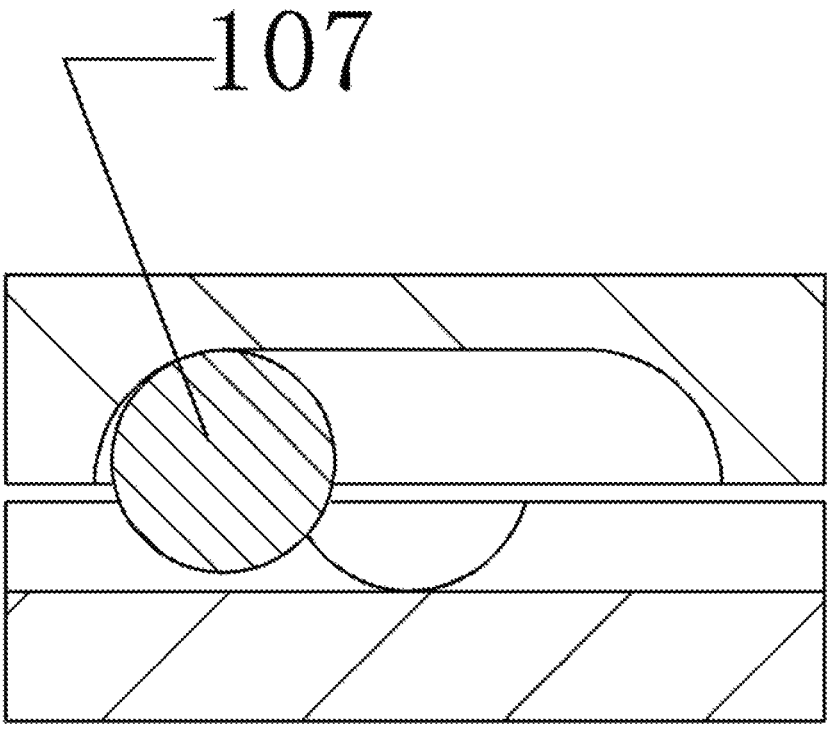
FIG. 10 is a sectional view of a controlled cavity in locking state of the invention.
Figure 11:
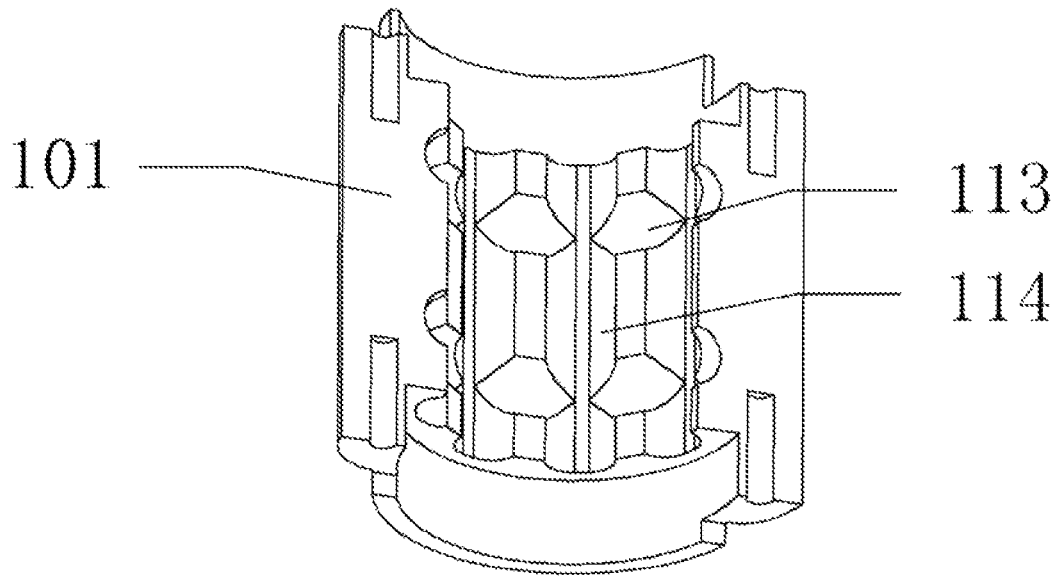
FIG. 11 is a sectional perspective view of a lock cylinder housing of the invention.

FIG. 10 is a sectional view of a controlled cavity in locking state. Under the external force, the controlled cavity enters into locking state when the pin moves to the indicated position.

Additionally, in this embodiment of the invention, the depth of the pin vertically moving grooves 114 is the same as the depth of the pin horizontally rotary groove 113 to ensure that the free pins are movable. The sum of the depth of the pin vertically moving grooves 114 and the depth of the pin vertical sliding grooves 112 is not less than the dimension of the big pins 107, to ensure that the big pins 107 are freely movable. The depth of the pin vertically moving grooves 114 and the depth of the pin horizontally rotary grooves 113 are less than the dimension of the small pins 108 and the depth of the pin vertical sliding grooves 112 is not less than the dimension of the small pins 108, to ensure that the small pins 108 would not affect the rotation of the lock knob 104 in the normal unlocking state.

To improve the waterproof and dustproof effects of the technical solution of the invention, a dustproof device is provided within the unlocking hole 116. The dustproof device includes a spring 109 and a dustproof end cover 110. An end of the spring 109 is located at the bottom of the unlocking hole 116 and connected to the lock knob 104. The other end of the spring 109 is connected to the dustproof end cover 110. In the locking state, the dustproof end cover 110 is pushed to tire opening of the unlocking hole 116 by the spring 109 In addition, an O type sealing, ring 105 and a sealing gasket 106 are provided successively from outside to inside, along the outer circwnference of the lock knob 104. The O type sealing ring 105 and the sealing gasket 106 are located between the lock cylinder front end cover 102 and the lock cylinder housing 101, and in the gap between the lock cylinder rear end cover 103 and the lock cylinder housing 101.

The principle of the unlocking is provided as follows: alter a correct magnetic coding key 115 is inserted into the unlocking hole 116, the free pins all move to the unlocking position due to the magnetic attraction of the magnetic coding key 115. At this point, the lock knob 104 and the lock cylinder housing 101 can be relatively rotated, and thus the lock cylinder can be unlocked.

The above embodiment is on illustrative, and not intended to limit the invention. All equivalent changes and modifications according to the invention should be covered by the scope of the claims.

We claim:

1. A magnetic coding free pin type lock cylinder structure, comprising:

a lock cylinder housing;

a lock knob rotationally disposed within the lock cylinder housing;

a lock cylinder front end cover and a lock cylinder rear end cover respectively located at two ends of the lock cylinder housing, wherein, at least one pin vertically moving groove and at least one pin horizontally rotary groove are provided on an inner wall of the lock cylinder housing, an unlocking hole for a magnetic coding key is provided axially at an end of the lock knob, opposite to the lock cylinder front end cover, a plurality of pin vertical sliding grooves are provided on an outer wall of the lock knob, free pins are provided in at least one of the plurality of pin vertical sliding grooves, and the free pins are big pins or/and small pins;

wherein pin moving cavities are formed by the pin vertical sliding grooves and the corresponding pin vertically moving grooves, and each pin moving cavity intersects with the pin horizontally rotary grooves;

wherein a depth of the pin vertically moving grooves is the same as a depth of the pin horizontally rotary grooves, and a sum of the depth of the pin vertically moving grooves and a depth of the pin vertical sliding grooves is not less than a dimension of the big pins, to ensure that the big pins are freely movable, the depth of the pin vertically moving grooves and the depth of the pin horizontally rotary grooves are less than a dimension of the small pins and the depth of the pin vertical sliding grooves is more than or equal to the dimension of the small pins; when the lock cylinder is in a locking state, at least one big pin is located within the pin moving cavities separate from the pin horizontally rotary grooves, or at least one small pin is not entirely located within the pin vertical sliding grooves, when the lock cylinder is in an unlocking state, the big pins are located within the pin moving cavities intersecting with the pin horizontally rotary grooves and the small pins are entirely located within the pin vertical sliding grooves.

2. The magnetic coding free pin type lock cylinder structure of claim 1, wherein a dustproof device is provided within the unlocking hole, the dustproof device includes a spring and a dustproof end cover, an end of the spring is located at a bottom of the unlocking hole and connected to the lock knob, and an other end of the spring is connected to the dustproof end cover, in the locking state, the dustproof end cover is pushed to an opening of the unlocking hole by the spring.

3. The magnetic coding free pin type lock cylinder structure of claim 1, wherein the lock knob is located along an axis of the lock cylinder housing, and the lock cylinder front end cover and the lock cylinder rear end cover are respectively located at two ends of the lock cylinder housing and envelop the lock knob.

4. The magnetic coding free pin type lack cylinder structure of claim 1, wherein an O type sealing ring and a sealing gasket are provided successively from outside to inside, along an outer circumference of the lock knob, and the O type sealing ring and the sealing gasket are located between the lock cylinder front end cover and the lock cylinder housing, and in a gap between the lock cylinder rear end cover and the lock cylinder housing.

5. The magnetic coding free pin type lock cylinder structure of claim 1, wherein the unlocking hole is a cylindrical hole, and a groove engaged with the magnetic coding key is provided on a side wall of an opening of the unlocking hole.

6. The magnetic coding free pin type lock cylinder structure of claim 1, wherein the free pins are spherical or cylindrical.

* * * * *